United States Patent [19]

Eguchi

[11] Patent Number: 4,606,867

[45] Date of Patent: Aug. 19, 1986

[54] APPARATUS FOR LIFTING MASSES OF WATER BY UTILIZING AIR BUBBLES

[76] Inventor: Masayuki Eguchi, 36 Higashigota-cho, Iwakura, Sakyo-ku, Kyoto, Kyoto, Japan

[21] Appl. No.: 758,283

[22] Filed: Jul. 24, 1985

[30] Foreign Application Priority Data

Jul. 31, 1984 [JP] Japan ..... 59-162418

[51] Int. Cl.[4] ..... B01F 3/04

[52] U.S. Cl. ..... 261/122; 261/123; 261/124

[58] Field of Search ..... 261/122, 123, 124

[56] References Cited

U.S. PATENT DOCUMENTS

| | | | |
|---|---|---|---|
| 3,664,647 | 5/1972 | Snow et al. | 261/122 |
| 3,768,981 | 10/1973 | Alliger | 261/122 |
| 3,880,965 | 4/1975 | Dudis et al. | 261/124 |
| 4,165,286 | 8/1979 | Schreiber et al. | 261/122 |
| 4,350,589 | 9/1982 | Stog | 261/122 |
| 4,539,184 | 9/1985 | Stenhning | 261/122 |

FOREIGN PATENT DOCUMENTS

| | | | |
|---|---|---|---|
| 3124233 | 1/1983 | Fed. Rep. of Germany | 261/122 |
| 195735 | 4/1923 | United Kingdom | 261/122 |

*Primary Examiner*—Tim Miles

*Attorney, Agent, or Firm*—Kirschstein, Kirschstein, Ottinger & Israel

[57] ABSTRACT

The apparatus of this invention has an air pipe which continuously forms air bubbles of fixed size. These bubbles are caught by a screen in the form of a net and united to grow. Grown bubbles are suddenly spouted from the air spout holes of the screen and rise together with masses of water.

6 Claims, 3 Drawing Figures

APPARATUS FOR LIFTING MASSES OF WATER BY UTILIZING AIR BUBBLES

BACKGROUND OF THE INVENTION

This invention relates to an apparatus for lifting masses of water by utilizing air bubbles, to thereby agitate nutrient matters lying on the sea bottom for forming a fishing ground.

Attempts have heretofore been made to agitate and lift nutrient matters lying on the sea bottom. If nutrient matters are lifted, they will be subjected to the sunlight, accelerating the growth of phytoplankton. Therefore, the growth of zooplankton which eat phytoplankton is hastened. As a result, fishes gather together, forming a fishing ground.

However, to agitate and lift nutrient matters, it has heretofore required complicated equipment and much power. Thus, it involves high cost and is not practical.

SUMMARY OF THE INVENTION

Accordingly, an object of this invention is to provide an apparatus which causes air bubbles holding masses of water to rise from within the water to the water surface so as to project the masses of water above the water surface, whereby convection and agitation of water are caused in the water while masses of water are projected above the water surface and then fall down.

Another object of the invention is to provide an apparatus which utilizes said convection of the water to agitate nutrient matters lying on the sea bottom to lift them, thus accelerating the growth of phytoplankton and zooplankton to cause fishes to gather together, forming a fishing ground.

Another object of the invention is to provide an apparatus capable of agitating and lifting nutrient matters on the sea bottom by using a simple arrangement and less power.

A further object of the invention is to provide an apparatus which utilizes air bubbles to lift masses of water, thereby agitating and lifting nutrient matters.

An additional object of the invention is to provide an apparatus which utilizes air bubbles to lift masses of water and uses the energy of upward motion of said masses as a power source to do some work or other.

Yet another object of the invention is to provide an apparatus wherein air bubbles holding masses of water are caused to go up to serve as walls for surrounding a limited region, thus forming an aquafarm or a bathing area having no partition walls.

According to this invention, an air pipe is installed in the water as on the sea bottom to extend substantially horizontal. The air pipe has a number of longitudinally spaced air spout ports formed therein to spout air for continuously forming air bubbles of fixed size. Bubble catching means having a screen catches the bubbles from said air pipe. The screen is in the form of a net having such a mesh size as not to allow bubbles from the air pipe to pass therethrough and is disposed above and substantially parallel to the air pipe to cover the latter and is curved to surround the air pipe. Further, a pair of end walls are positioned at opposite ends of the screen, while a plurality of partition walls are disposed between said end walls and spaced from each other longitudinally of the screen. The end walls and partition walls extend substantially vertically from the screen toward the pipe and cooperate with the screen to form a plurality of bubble chambers. Further, a plurality of bubble spout holes of low net strand density are formed in the ridge of the curve and are located each substantially intermediate between adjacent end and partition walls of the catching means. Therefore, bubbles are caught in each bubble chamber and united to grow. The grown bubbles are suddenly spouted from said bubble spout holes to rise together with masses of water.

DESCRIPTION OF THE PREFERRED EMBODIMENT

Figure 1:
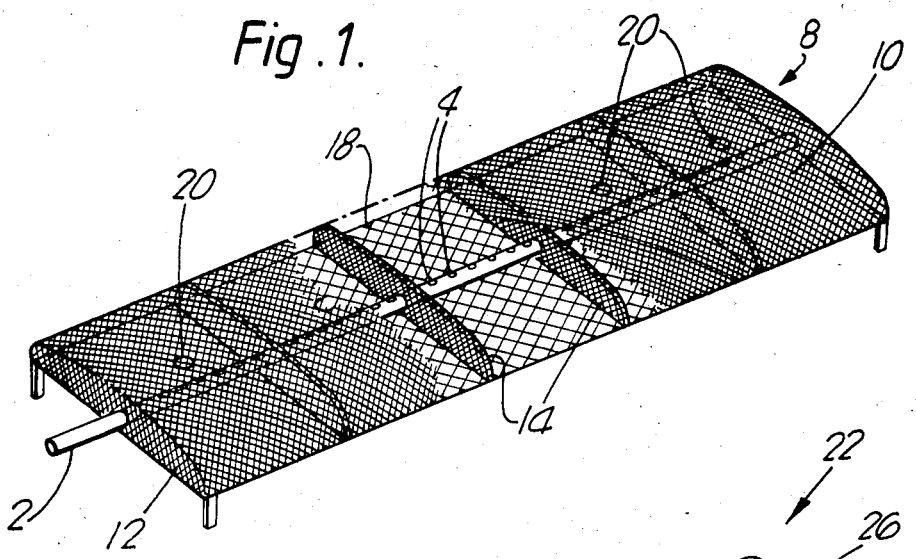
FIG. 1 is a perspective view of an air pipe and bubble catching means used in an apparatus according to this invention.
Figure 2:
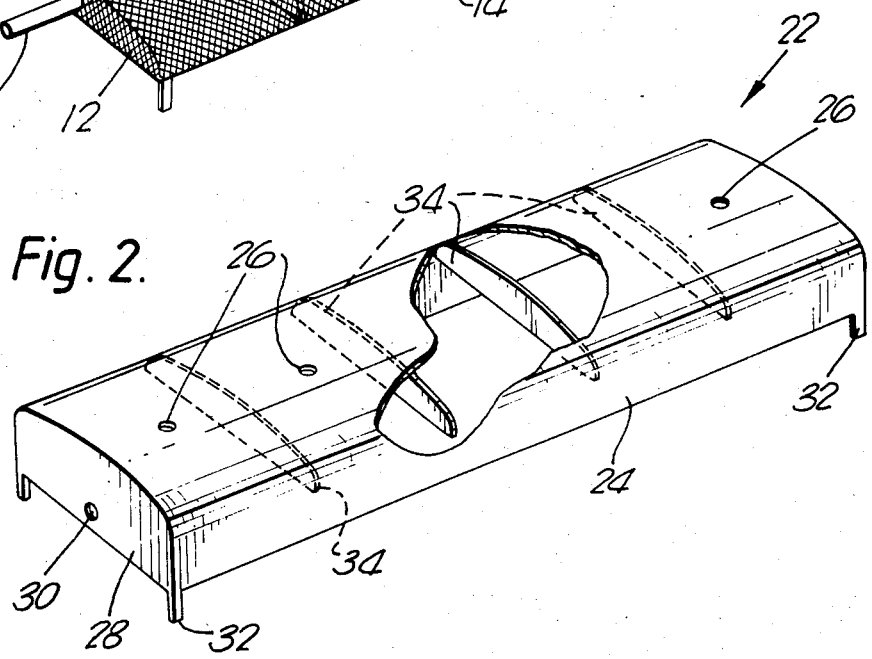
FIG. 2 is a perspective view of a cover used in said apparatus.
Figure 3:
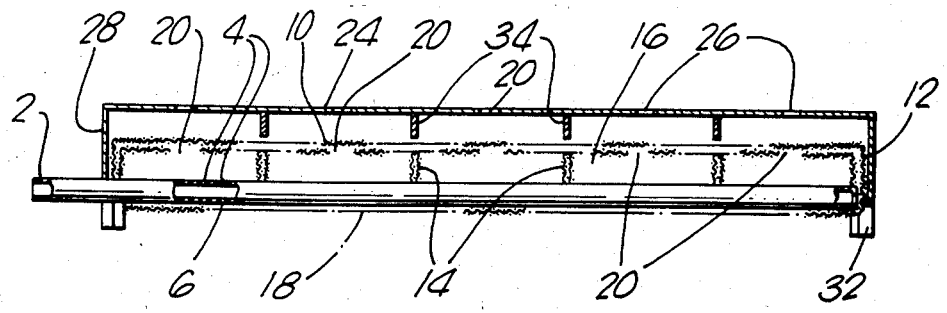
FIG. 3 is a sectional view of the air pipe, bubble catching means and cover shown in FIGS. 1 and 2.

An apparatus according to this invention has an air pipe shown at 2 which is installed in the water, e.g., on the sea bottom, to extend substantially horizontal. The air pipe 2 has a number of air spout ports 4 on its upper surface and is connected to a compressor installed above the water surface, as on a ship. Thus, air is fed from the compressor to the air pipe and spouted from the spout ports 4, whereby air bubbles of fixed size are continuously formed. As best shown in FIG. 3, the air pipe 2 has a number of passage ports 6 formed in its lower surface and spaced from each other longitudinally of the air pipe.

Catching means is shown at 8 which has a screen 10. The screen 10 is in the form of a net having such a mesh size as not to allow bubbles from the spout ports 4 of the air pipe to pass therethrough and is disposed above and substantially parallel to the air pipe 2 to cover the latter and curved to surround the air pipe 2. A pair of end walls 12 are disposed at opposite ends of the screen 10 and a plurality of partition walls 14 are disposed between said end walls 12 and spaced from each other longitudinally of the screen 10. The end walls 12 and partition walls 14 are formed of the same net as the screen 10 and connected to the latter and extend vertically from the screen 10 toward the pipe 2 to cooperate with the screen 10 to form a plurality of bubble chambers 16. The pipe 2 extends through one end wall 12 and all partition walls 14 to the other end wall. A flat bottom wall 18 is disposed below the air pipe 2. The bottom wall 18 is formed of the same net as the screen 10, the latter extending to the bottom wall 18 to which it is connected.

The screen 10 has a plurality of bubble spout holes 20 of low net strand density formed in the ridge of the curve of the screen 10, said spout holes 20 being located each substantially intermediate between adjacent end and partition walls 12 and 14. In the illustrated embodiment, the screen 10 comprises a plurality of layers of net and the spout holes 20 thereof are formed by lessening the layers of net. Alternatively, the bubble spout holes 20 may be formed by making the mesh size of the corresponding portion larger than that of the other portion of the screen 10.

Thus, in each bubble chamber 16, air bubbles of fixed size continuously rise from the spout ports 4 of the air pipe 2 toward the screen 10. When the bubbles reach the screen 10, they adhere to the screen 10 by the surface tension of water, failing to pass through the screen 10. Therefore, bubbles are caught in each bubble chamber 16 and united to grow. As the bubbles grow, their buoyancy increases. When the buoyancy of bubbles exeeds a certain value, the bubbles which have grown at the spout holes 20 pass through the latter to rise. Thus, a negative pressure is produced in each spout hole 20, drawing up water which is present just below the spout hole 20. Further, bubbles around the spout hole 20 are drawn to the latter by the surface tension of water and discharged from the spout hole 20. Therefore, bubbles are suddenly spouted from the spout holes 20, with water involved therein; thus, bubbles rise together with masses of water.

Further, this apparatus has a cover 22 made of rigid material. The cover 22 has a peripheral wall 24 including bubble passage ports 26. The peripheral wall 24 is disposed above and parallel to the screen 10 to cover the latter, and the bubble passage ports 26 are located at positions corresponding to the bubble spout holes 20 of the screen 10. Further, a pair of end walls 28 are disposed at opposite ends of the peripheral wall 24 and extend vertically from the latter toward the air pipe 2. The air pipe extends through a hole 30 in one end wall 28 to the other end wall 28, said air pipe being fixed to both end walls 28. The cover 22 has four legs 32 which are integral with the peripheral wall 24 and end walls 28. Further, a plurality of partition walls 34 are fixed to the peripheral wall 24 of the cover 22. The partition walls 34 are disposed between the end walls 28 and spaced from each other longitudinally of the peripheral wall 24 and extend vertically from the latter toward the screen 10.

Therefore, bubbles and masses of water spouted from the bubble spout holes 20 of the screen 10 pass through the bubble passage ports 26 of the cover 22, attaining a shape and size corresponding to the passage ports 26 as they rise. Thereafter, the bubbles take in water from the surroundings to grow masses of water and rise to the water surface with masses of water.

This apparatus can be used to form a fishing ground by alluring fishes to gather together. Since bubbles rise together with masses of water, water flows around the apparatus. Thus, nutrient matters on the sea bottom are agitated to rise together with masses of water and the matters receive the rays of the sun, so that the growth of phytoplankton is accelerated. Accordingly, the growth of zooplankton which eat phytoplankton is accelerated. As a result, fishes gather together, forming a fishing ground. This apparatus is simple in construction and needs only to feed air to the air pipe 2. High power is not required and the cost is low. Moreover, the apparatus is capable of efficiently agitating and lifting nutrient matters on the sea bottom.

This agitating action in the water lifts droppings of fishes and sludge from the sea bottom to the surface to subject them to sunlight or to oxidize them with oxygen supplied by falling masses of water so as to decompose organic salts and hydrogen sulfide to make them harmless.

It is also possible to utilize the energy of upward motion of air bubbles and masses of water in this apparatus as a power source to do some work or other.

While there have heretofore been known apparatuses which simply continuously lift bubbles, the apparatus of this invention is capable of more efficiently lifting more masses of water than these known apparatus, as ascertained by experiments.

What is claimed is:

1. An apparatus for lifting masses of water by utilizing air bubbles, comprising:

an air pipe installed in the water and substantially horizontally extending, said air pipe having a plurality of longitudinally spaced air spout ports adapted to blow air so as to continuously form air bubbles of fixed size, bubble catching means for catching bubbles from the spout ports of said air pipe, said catching means having a screen in the form of a net having such a mesh size as not to allow bubbles from said spout ports to pass therethrough, said screen being disposed above and substantially parallel to said air pipe to cover the latter and being curved to surround said air pipe, said catching means having a pair of end walls disposed at opposite ends of said screen and a plurality of partition walls disposed between said end walls and spaced from each other longitudinally of said screen, said end walls and partition walls extending substantially vertically from said screen toward said pipe to cooperate with said screen to form a plurality of bubble chambers, said screen having a plurality of bubble spout holes of low net strand density formed in the ridge of the curve, said spout holes being located each substantially intermediate between adjacent end and partition walls, the arrangement being such that bubbles are caught in each said bubble chamber and united to grow, the grown bubbles rising together with masses of water.

2. An apparatus as set forth in claim 1, wherein said air pipe is connected to a compressor installed above the water surface.

3. An apparatus as set forth in claim 1, wherein said screen comprises a plurality of layers of net and said spout holes are formed by lessening said layers of net.

4. An apparatus as set forth in claim 1, wherein said bubble spout holes are formed by making the mesh size of the corresponding portion larger than that of the other portion of the screen.

5. An apparatus as set forth in claim 1, wherein said end walls and said partition walls are formed of the same net as said screen.

6. An apparatus as set forth in claim 1, further comprising a cover having a peripheral wall disposed above and perallel to said screen to cover the latter, said peripheral wall of said cover having a plurality of bubble passage ports formed therein at positions corresponding to the bubble spout holes of said screen, said cover having a pair of end walls disposed at opposite ends of said peripheral wall and a plurality of partition walls disposed between said end walls and spaced from each other longitudinally of said peripheral wall, said end walls of said cover extending vertically from said peripheral wall toward said pipe, said partition walls extending vertically from said peripheral wall toward said screen.

* * * * *